US008241152B2

(12) United States Patent
Lima

(10) Patent No.: US 8,241,152 B2
(45) Date of Patent: Aug. 14, 2012

(54) SPORT INSTRUCTION SYSTEM

(76) Inventor: Rafael Cirne Lima, Oakland, CA (US)

( * ) Notice: Subject to any disclaimer, the term of this patent is extended or adjusted under 35 U.S.C. 154(b) by 0 days.

(21) Appl. No.: 13/135,075

(22) Filed: Jun. 23, 2011

(65) Prior Publication Data

US 2011/0319201 A1 Dec. 29, 2011

Related U.S. Application Data

(60) Provisional application No. 61/357,694, filed on Jun. 23, 2010.

(51) Int. Cl.
*A63B 69/00* (2006.01)
*A63B 69/38* (2006.01)

(52) U.S. Cl. ..... 473/422; 473/464; 473/458; 473/450

(58) Field of Classification Search ..... 473/422, 473/450, 458, 464, 438, 451, 461, 521, 523, 473/538, 549, 553, 564
See application file for complete search history.

(56) References Cited

U.S. PATENT DOCUMENTS

| | | | | |
|---|---|---|---|---|
| 1,917,236 | A * | 7/1933 | Bloomstrand | 434/247 |
| 2,928,678 | A * | 3/1960 | Cutting | 473/206 |
| 3,231,271 | A * | 1/1966 | Murphy | 473/461 |
| 3,353,824 | A * | 11/1967 | Hamson, Jr. | 473/458 |
| 5,427,376 | A * | 6/1995 | Cummings et al. | 473/201 |
| 5,695,067 | A * | 12/1997 | Harvey | 206/579 |
| 6,656,054 | B2 * | 12/2003 | Ulrich | 473/549 |
| 7,059,862 | B2 * | 6/2006 | McGinley | 434/247 |
| 7,172,521 | B1 * | 2/2007 | Novis | 473/446 |
| 7,785,211 | B2 * | 8/2010 | Hackenberg | 473/256 |
| 8,012,048 | B1 * | 9/2011 | Montalvo | 473/459 |
| 2005/0119071 | A1 * | 6/2005 | Carbonero | 473/422 |

FOREIGN PATENT DOCUMENTS

CA 2021300 A * 1/1992

* cited by examiner

*Primary Examiner* — Mitra Aryanpour
(74) *Attorney, Agent, or Firm* — Brian Beverly; Beeson Skinner Beverly, LLP

(57) ABSTRACT

A sport instruction system for use in training for a sport requiring use of equipment having a gripping handle comprises a plurality of flexible equipment handle cue bands, each cue band displaying a unique visual cue, each cue band sized for securement to the gripping handle of the equipment in a location visible to the player of the sport when holding the gripping handle of the equipment, a plurality of sport specific instruction cards, each card having training theme indicia corresponding to one of the visual cues on the equipment handle cue bands, performance problem indicia related to the training theme indicia, and training instruction indicia related to the performance indicia, such that viewing the visual cue on one of the cue bands during training focuses the players attention on training instructions conveyed by the training instruction indicia on the instruction card having training theme corresponding to the visual cue.

6 Claims, 4 Drawing Sheets

SPORT INSTRUCTION SYSTEM

FIELD OF THE INVENTION

The present invention generally relates to sports training, and particularly, to a self-training system for a sport that requires use of equipment having a gripping handle.

BACKGROUND

Several popular sports require the use of specific equipment in order to play or perform the sport. And quite often, the necessary equipment has a handle for the player to grip in order to manipulate the equipment. This type of equipment is commonly used to strike, launch, or catch a ball. Examples of such equipment include racquets, clubs, sticks, and bats, used in sports such as tennis, golf, lacrosse, and baseball, respectively.

Live coaching, training, or instruction by a qualified expert in techniques used to play or perform a particular sport is widely accepted as one of the best ways to learn a sport. While instruction in the presence of a coach or trainer is generally preferable, it is not available at all times. Quite often a player of a given sport must train on his or her own in between sessions spent with the coach. In such cases, a player is responsible for his or her own training.

A variety of tools are available for an individual player to engage in self-training in a sport. Books, videos, and specially designed apparatuses, can provide useful instruction and guidance to a player learning to play or perform a sport. But these tools have their limitations. For instance, when a player is reading a book or watching a video to gain instruction in a sport, the player is not actively practicing the sport, and thus the instructive material gleaned from the book or video may not be learned or remembered during actual physical play or performance of the sport. This is usually the product of a lapse in time between when the book was read or the video was watched, and when the sport is played or performed. And while use of a specialized training apparatus can be effective in developing play or performance techniques, practicing with a training apparatus does not always result in improved muscle or cognitive memory and corresponding better performance, when in subsequent play or performance the training apparatus is not used.

There is a need for an individualized self-training system for instructing in the play or performance of a sport that can also improve the physical actualization of learned or memorized instructive concepts during play or performance of the sport.

BRIEF DESCRIPTION OF THE ILLUSTRATIONS

DESCRIPTION OF THE ILLUSTRATED EMBODIMENT

Figure 1:
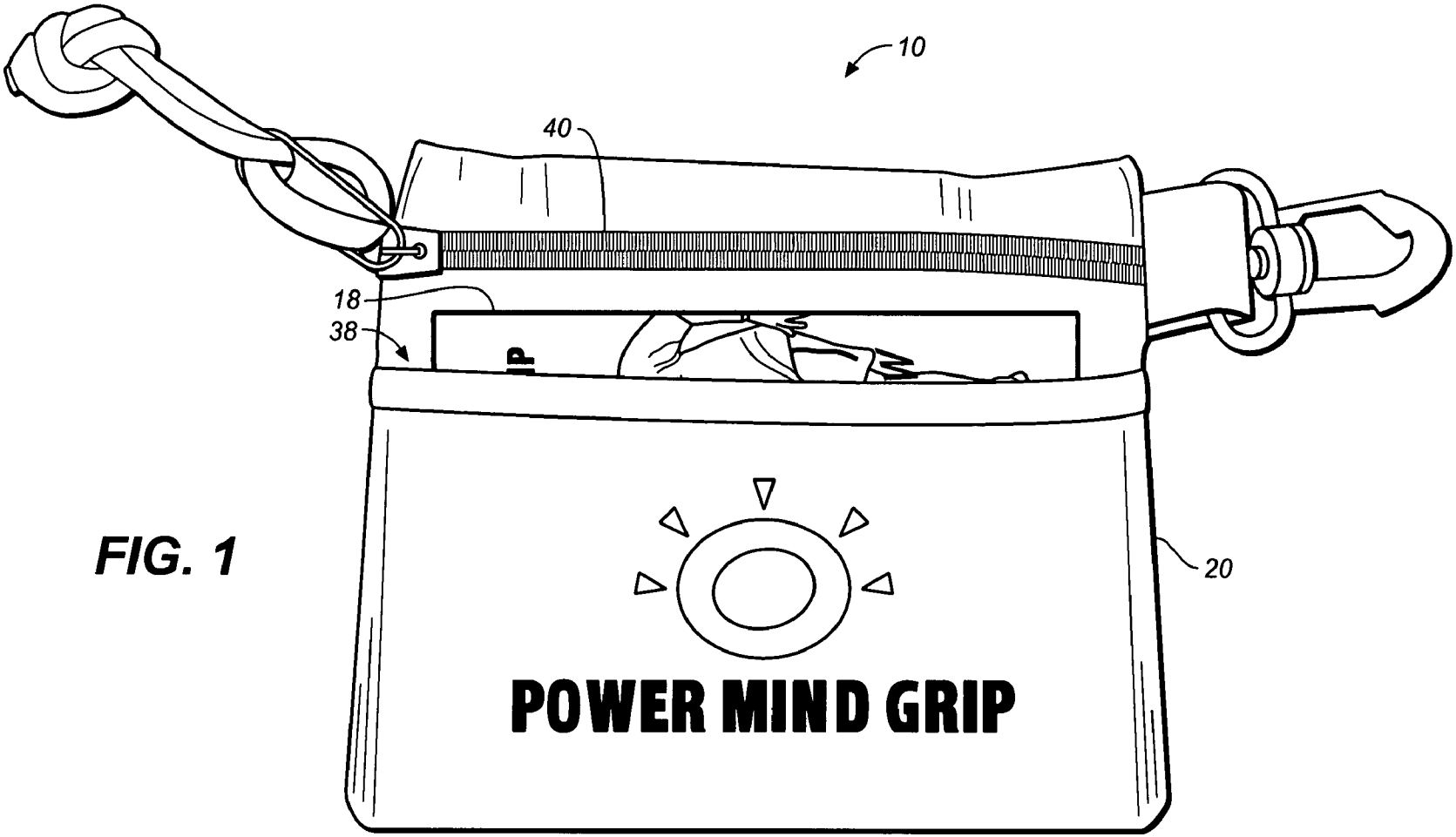
FIG. 1 is a plan view of a pouch for a sport instruction system according to the invention.

A sport instruction system 10 for self-training and developing skills to play or perform a sport that requires use of hand-held equipment is shown in FIGS. 1-4. This system comprises a set of sport-specific instruction cards 12, equipment handle cue bands 14 with visual cues that correspond to the sport-specific instruction cards 12, a system user instruction card 16, a system general information card 18, and a pouch 20 for holding these items.

Figure 2:
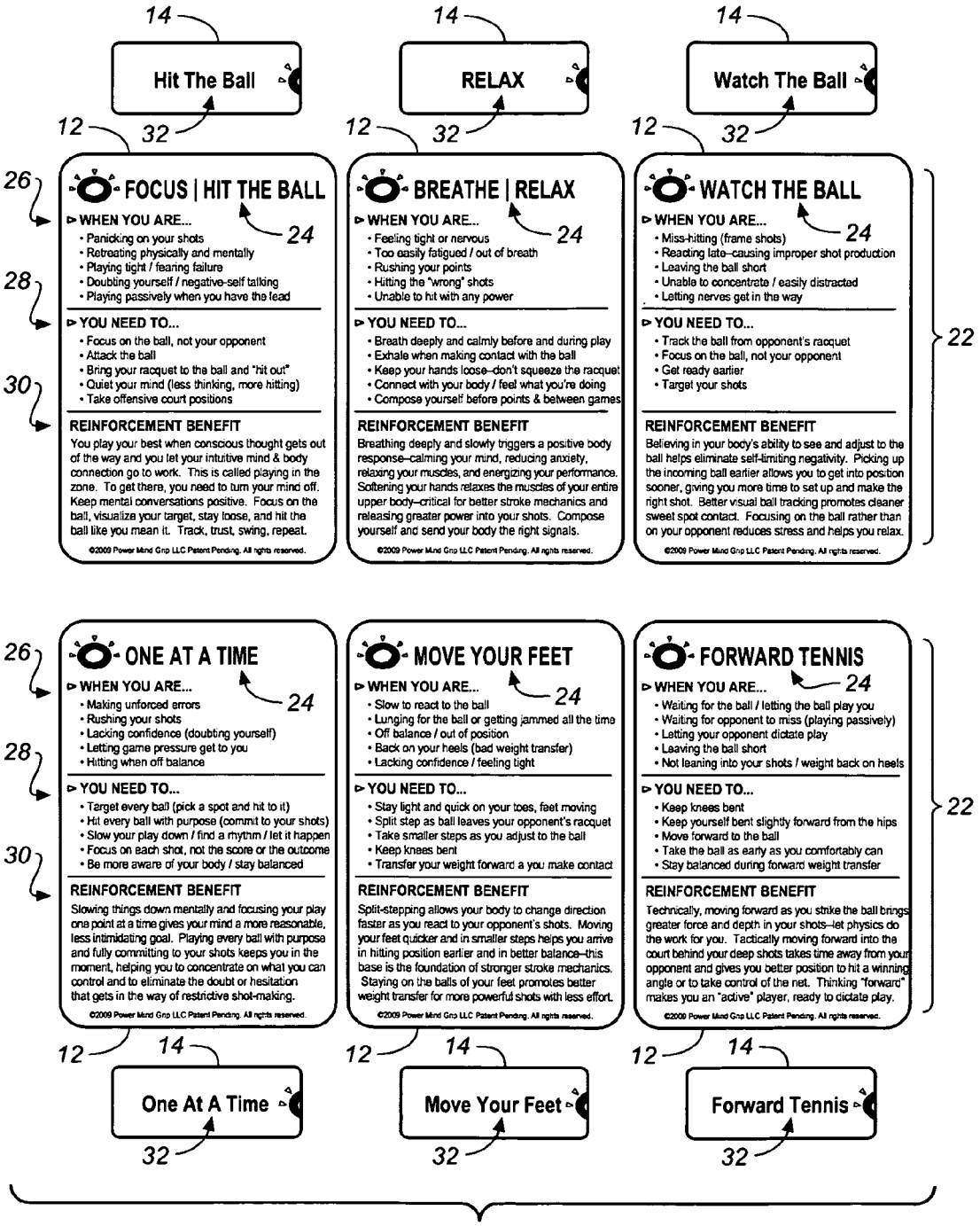
FIG. 2 is a plan view of a set of sport-specific instruction cards and equipment handle bands having instructional visual cues, each equipment handle associated with one of the sport specific-instruction cards, the sport specific instruction cards and equipment handle bands sized for retention in the pouch shown in FIG. 1.

Referring to FIG. 2, the set of sport specific instruction cards 12 includes one, two, or multi-sided cards or pamphlets that each display visual indicia 22 referencing a unique general training theme or concept related to the play or performance of the given sport set forth in the title 24 at the top of the card. Each card 12 also includes a list of play or performance problems that relate to the theme or a concept given under the heading "When You Are . . . " 26, specific training instructions for addressing the listed problems under the heading "You Need To . . . " 28, and general reasoning providing is support for the listed instructions under the heading "Reinforcement Benefit" 30.

Each equipment handle cue band 14 has a generally flat surface, or at least a portion with a flattened surface, for placement of a visual cue 32. The bands are flexible being made of an elastic material that can stretch to accommodate equipment handles having a range of diameters. It is contemplated that the bands, alternatively, could be an adjustable strip that may be secured around the handle or any other device capable of displaying one of the themes and that can be easily attached and removed from the handle of a sports racket or the like. The visual cue 32 exists on the flattened portion of the outer surface of the band so that it is prominently visible to the player when gripping the handle bearing the band. Each visual cue 32 corresponds to one of the themes set forth in the title 24 of one of the sport-specific instruction cards 12 and conveys a short message to trigger and reinforce in the player's memory during play of the sport the material taught in the corresponding instruction card so that the player can immediately adjust his or her performance according to the instructions provided on the instruction card. Generally, the number of cue bands 14 in the system will correspond to the number of sport-specific instruction cards 12.

Figure 3:
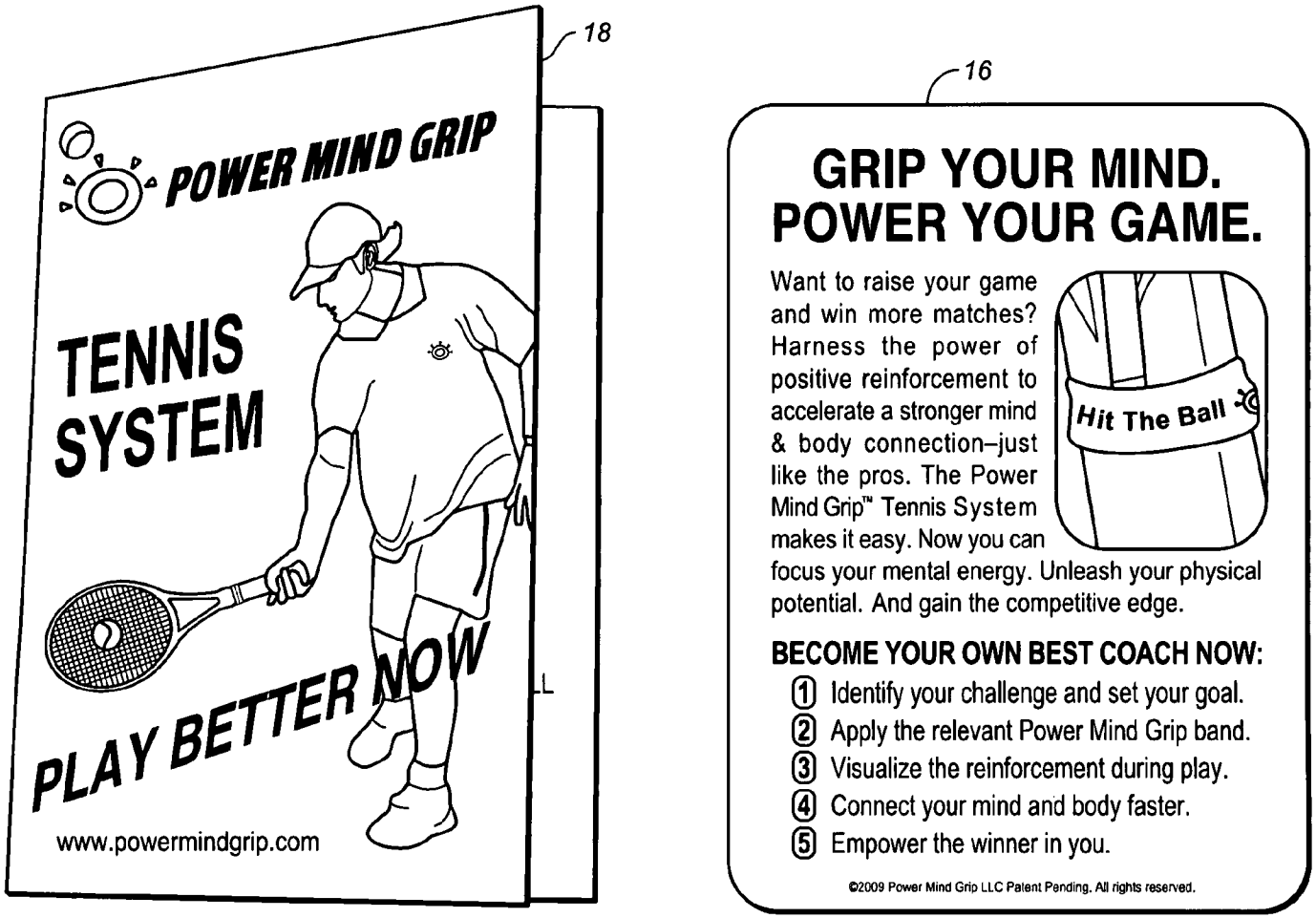
FIG. 3 is a plan view of an instructional card having instructions on how to use the sport instruction system.
Figure 4:
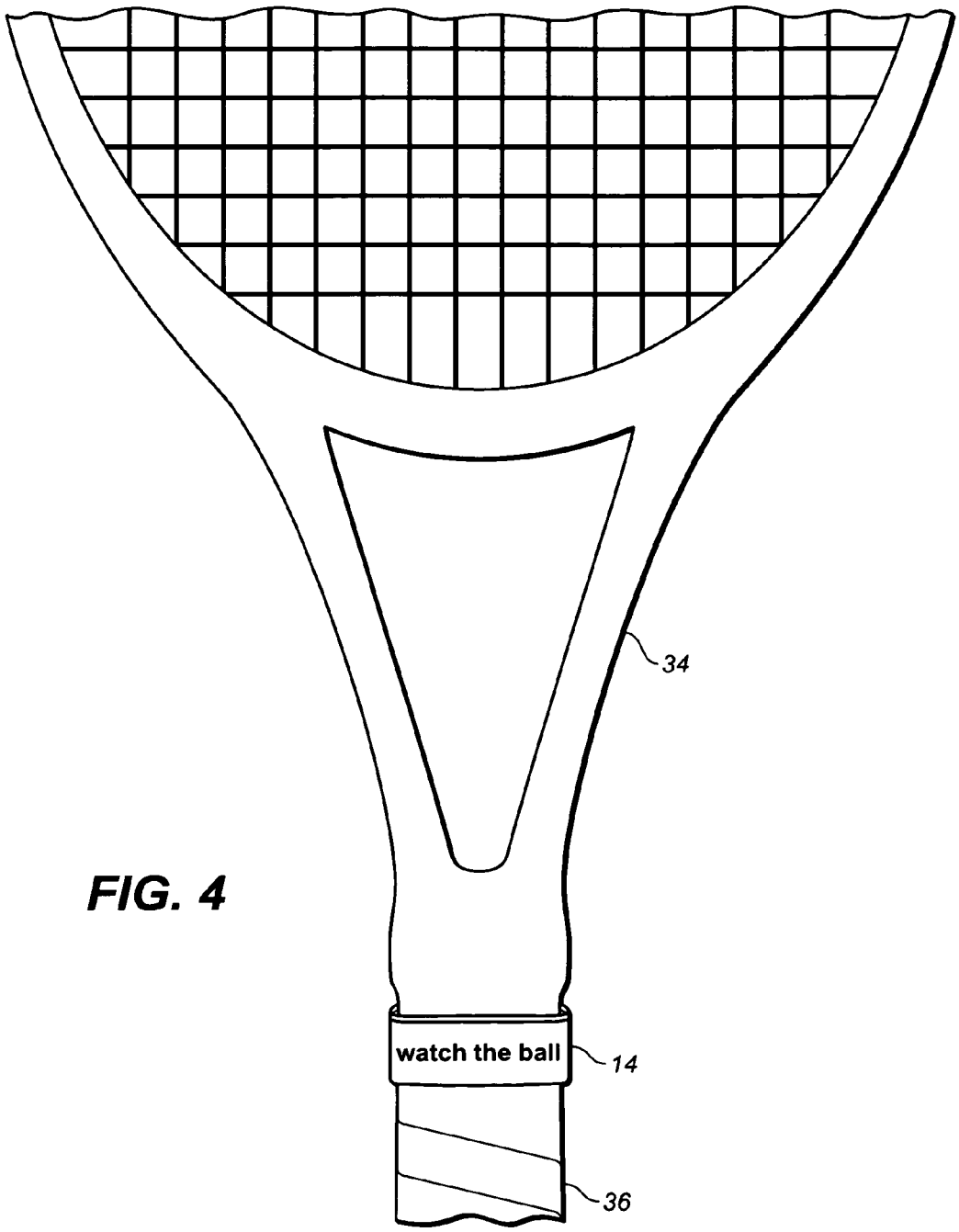
FIG. 4 is a plan view of the handle of a tennis racket with an instructional visual cue band placed on the handle above the grip.

The system user instruction card 16 shown in FIG. 3 provides instructions for using the system. A user may choose a sport-specific instruction card based upon personal choice or self-assessment of skills, or completely at random. Then the user reads, studies, and mentally processes the instructional information on the card. This is followed by identifying the cue band 14 that corresponds to the instructional card 12, and securing the band 14 to the handle 36 of the equipment in a location toward the top of the grip that is easily visible to the user when gripping the handle 36 of the equipment, as depicted in FIG. 4. In play or training, when the user sees the visual cue 32 on the cue band 14, the visual cue triggers the user's memory of the material taught in the corresponding instructional card 12 and the user can then immediately incorporate the learned material into his or her performance, thus reinforcing and actualizing the instructive concepts.

Also shown in FIG. 3 is the general information card 18 that provides basic marketing information about the system and lists the system components and their cooperative effect.

The sport-specific instruction cards 12, equipment handle cue bands 14, system user instruction card 16, and system general information card 18, are all stored in a durable, appropriately sized pouch 20. In the illustrated embodiment, the pouch includes a large compartment and a pocket 38. The large compartment has a zippered opening 40 and is sized to hold the bands and all of the cards. The pocket holds a smaller quantity of cards and bands, as compared to the large compartment, and does not have a zippered or closable opening. The pouch is incorporated into the system for providing a means of storage, and it is anticipated that other suitable storage options are available. The system may also exist without the pouch or other means of storage.

While embodiments of a sport instruction system have been described and illustrated, it will be recognized and appreciated by those skilled in the art that modifications thereof are within the true spirit and scope of the invention. The appended claims are intended to cover all such modifications.

I claim:

1. A sport instruction system for use in training for a sport requiring use of equipment having a gripping handle, the sport instruction system comprising:

a plurality of flexible equipment handle cue bands, each cue band sized for securement to the gripping handle in a location prominently visible to a player of the sport when holding the gripping handle of the equipment, each of said plurality of cue bands displaying a unique visual cue, and a plurality of sport-specific instruction cards, each of said plurality of instruction cards having training theme indicia corresponding to one of said unique visual cues, performance problem indicia related to said unique training theme indicia, and training instruction indicia related to said performance indicia, such that viewing the visual cue on one of said cue bands placed on the gripping handle during training for the sport focuses the player's attention on training instructions conveyed by the training instruction indicia on the instruction card having the training theme corresponding to said visual cue.

2. The sport instruction system of claim 1 further comprising:

each of said plurality of cue bands having a generally flat surface for displaying thereon one of said visual cues.

3. The sport instruction system of claim 1 further comprising:

each of said plurality of cue bands sized for placement around the gripping handle of a tennis racket.

4. The sport instruction system of claim 1 further comprising:

each of said plurality of instruction cards having reinforcement benefit indicia providing reinforcement benefits to a player for implementing the training instructions conveyed by said training instruction indicia.

5. The sport instruction system of claim 1 further comprising:

a pouch having a compartment and a pocket, the compartment having a zippered opening and being sized to hold said plurality of equipment handle cue bands and said plurality of instruction cards, and said pocket being smaller than said compartment.

6. A sport instruction method for training for a sport requiring use of equipment having a gripping handle, the method comprising:

selecting performance problem indicia displayed on one of one or more sport-specific instruction cards, identifying training theme indicia displayed on said instruction card, said training theme indicia related to said performance problem indicia, selecting one of one or more flexible equipment handle cue bands having a unique visual cue corresponding to said training theme indicia, each of said one or more flexible equipment handle cue bands having a unique visual cue corresponding to the training theme indicia on one of said one or more instruction cards, and placing said selected flexible equipment handle cue band around the gripping handle such that viewing the unique visual cue on said selected cue band during training for the sport focuses a player's attention on training instructions conveyed by training instruction indicia displayed on the instruction card having said training theme indicia.

* * * * *

UNITED STATES PATENT AND TRADEMARK OFFICE

CERTIFICATE OF CORRECTION

PATENT NO. : 8,241,152 B2
APPLICATION NO. : 13/135075
DATED : August 14, 2012
INVENTOR(S) : Rafael Cirne Lima It is certified that error appears in the above-identified patent and that said Letters Patent is hereby corrected as shown below:

In the Specification

Col. 2, line 22, "is" should be deleted between "providing" and "support."

Signed and Sealed this
Eighth Day of October, 2013

Teresa Stanek Rea

Teresa Stanek Rea
*Deputy Director of the United States Patent and Trademark Office*